US010488148B2

(12) United States Patent
Johnson et al.

(10) Patent No.: US 10,488,148 B2
(45) Date of Patent: Nov. 26, 2019

(54) TOY GUN WITH MOVEABLE MAGAZINES

(71) Applicant: Alex Brands Buzz Bee Toys (HK) Limited, Kowloon (HK)

(72) Inventors: Brownie Johnson, Brooklyn, NY (US); Chor-Ming Ma, Kowloon (HK)

(73) Assignee: Alex Brands Buzz Bee Toys(HK)Limited, Kowloon (HK)

( * ) Notice: Subject to any disclaimer, the term of this patent is extended or adjusted under 35 U.S.C. 154(b) by 0 days.

(21) Appl. No.: 15/782,975

(22) Filed: Oct. 13, 2017

(65) Prior Publication Data

US 2019/0113303 A1 Apr. 18, 2019

(51) Int. Cl.

| | |
|---|---|
| ***F41B 11/00*** | (2013.01) |
| ***F41B 11/55*** | (2013.01) |
| ***F41B 11/89*** | (2013.01) |
| ***F41B 11/646*** | (2013.01) |

(52) U.S. Cl.

CPC ..... *F41B 11/55* (2013.01); *F41B 11/646* (2013.01); *F41B 11/89* (2013.01)

(58) Field of Classification Search

CPC ..... F41B 11/89; F41B 11/55; F41B 11/54; F41B 7/08; F41A 9/73

USPC ..... 124/66, 45, 51.1, 48, 56

See application file for complete search history.

(56) References Cited

U.S. PATENT DOCUMENTS 3,621,828 A * 11/1971 Hansen ..... F41J 9/30 124/47
3,968,783 A * 7/1976 Pfotenhauer ..... F41B 5/126 124/25
4,248,202 A * 2/1981 Jaworski ..... F41B 7/08 124/16
4,447,976 A * 5/1984 Cooper ..... F41A 9/63 42/18
4,524,673 A * 6/1985 Golden ..... F41A 9/74 89/33.02
4,619,063 A * 10/1986 Hill ..... F41A 9/68 42/19
4,628,627 A * 12/1986 Johnson ..... F41A 9/63 42/90
4,707,941 A * 11/1987 Eastman ..... F41A 9/68 42/49.02
4,840,110 A * 6/1989 Fischer ..... F41A 9/45 89/33.02
4,982,650 A * 1/1991 Bender-Zanoni ..... F41A 9/63 89/33.1
5,156,137 A * 10/1992 Clayton ..... F41B 7/00 124/27
5,343,850 A * 9/1994 Steer ..... A63H 27/14 124/59
5,373,833 A * 12/1994 D'Andrade ..... F41B 11/00 124/69
5,471,967 A * 12/1995 Matsuzaki ..... F41B 4/00 124/47
5,476,087 A * 12/1995 Kunimoto ..... F41B 11/56 124/73

(Continued)

*Primary Examiner* — Michael D David

(57) ABSTRACT

The invention relates to a toy gun having a barrel; a projectile launching mechanism arranged in a body of the gun for launching a projectile from the gun via the barrel; a plurality of magazines each of which is adapted to accommodate a plurality of projectiles; wherein the plurality of magazines are each arranged to move in turn to a projectile loading position to thereby align a projectile with the barrel for launching by the projectile launching mechanism.

20 Claims, 6 Drawing Sheets

(56) References Cited

U.S. PATENT DOCUMENTS 5,515,837 A * 5/1996 Nin ..... F41B 11/723 124/59
5,529,050 A * 6/1996 D'Andrade ..... F41B 11/723 124/1
5,535,729 A * 7/1996 Griffin ..... F41B 11/54 124/48
5,615,506 A * 4/1997 Jackson ..... F41A 9/63 42/50
5,996,564 A * 12/1999 Kotowski ..... F41B 4/00 124/6
6,279,562 B1 * 8/2001 Clayton ..... F41B 9/0018 124/59
6,598,329 B1 * 7/2003 Alexander ..... F41C 23/04 42/114
6,796,074 B1 * 9/2004 Obong ..... F42B 39/02 224/931
8,127,754 B1 * 3/2012 Johnson ..... F41B 11/646 124/66
8,640,374 B1 * 2/2014 Reichelt ..... F41C 27/00 42/106
9,097,484 B2 * 8/2015 Poirier ..... F41B 7/08
D739,468 S * 9/2015 Champ ..... D21/302
9,134,091 B2 * 9/2015 Busse ..... F41B 11/89
9,341,422 B2 * 5/2016 Rodich ..... F41A 9/73
9,347,735 B2 * 5/2016 Falkowski, II ..... F41A 3/72
9,389,042 B1 * 7/2016 Clayton ..... F41B 11/642
9,395,142 B2 * 7/2016 Rodich ..... F41B 5/126
9,513,075 B2 * 12/2016 Lallier ..... F41A 9/73
9,664,470 B2 * 5/2017 No ..... F41A 9/75
9,784,524 B1 * 10/2017 Ma ..... F41B 7/003
2010/0147277 A1 * 6/2010 Zimmerman ..... F41A 9/25 124/56
2010/0282229 A1 * 11/2010 Tran ..... F41A 9/38 124/71
2011/0000473 A1 * 1/2011 Perron ..... F41B 7/08 124/17
2011/0113668 A1 * 5/2011 Pestana ..... F41A 9/63 42/90
2011/0146645 A1 * 6/2011 Ma ..... F41B 11/64 124/59
2012/0285433 A1 * 11/2012 Chor-Ming ..... F41A 9/27 124/51.1
2012/0285436 A1 * 11/2012 Chor-Ming ..... F41A 9/27 124/80
2012/0304975 A1 * 12/2012 Ma ..... F41B 11/681 124/73
2012/0312288 A1 * 12/2012 Bunker ..... A01M 1/02 124/45
2013/0247893 A1 * 9/2013 Yang ..... F41B 11/55 124/74
2013/0312726 A1 * 11/2013 Mead ..... F41A 9/26 124/78
2014/0096755 A1 * 4/2014 Larmer ..... F41B 11/55 124/52
2014/0237876 A1 * 8/2014 Macy ..... F41A 9/68 42/49.01
2014/0251119 A1 * 9/2014 Macy ..... F41B 11/54 89/33.02
2014/0338649 A1 * 11/2014 Williams ..... F41B 11/721 124/73
2014/0352677 A1 * 12/2014 Chia ..... F41B 11/70 124/66
2015/0007804 A1 * 1/2015 Tippmann, Jr. ..... F41B 11/722 124/73
2015/0253102 A1 * 9/2015 Macy ..... F41B 11/643 124/76
2015/0308782 A1 * 10/2015 Chia ..... F41B 11/70 124/78

* cited by examiner

TOY GUN WITH MOVEABLE MAGAZINES

FIELD OF THE INVENTION

The invention relates to a toy and, particularly, but not exclusively, to a projectile launching toy such as a toy gun.

BACKGROUND OF THE INVENTION

A variety of projectile firing toys such as, but not limited to, toy guns of various types are available in the market. Particularly, toy guns have been designed with both decorative and functional features in order to mimic the appearance, operation as well as a user's experience of real guns. For example, rifle and pump action toy guns have been developed to simulate the action required by a hand loading firearm. Various features have also been incorporated into traditional toy guns aiming to enhance the user's experience.

OBJECTS OF THE INVENTION

An object of the present invention is to provide a toy gun with an improved projectiles loading feature.

Another object of the present invention is to mitigate or obviate to some degree one or more problems associated with known projectile emitting toys, or at least to provide a useful alternative.

The above objects are met by the combination of features of the main claim; the sub-claims disclose further advantageous embodiments of the invention.

One skilled in the art will derive from the following description other objects of the invention. Therefore, the foregoing statements of object are not exhaustive and serve merely to illustrate some of the many objects of the present invention.

SUMMARY OF THE INVENTION

In a first main aspect, the invention provides a toy gun having a barrel, a projectile launching mechanism arranged in a body of the gun for launching a projectile from the gun via the barrel, and a plurality of magazines each of which is adapted to accommodate a plurality of projectiles. The plurality of magazines are each arranged to move in turn to a projectile loading position to thereby align a projectile with the barrel for launching by the projectile launching mechanism.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figure, of which.

DESCRIPTION OF PREFERRED EMBODIMENTS

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Figure 1A:
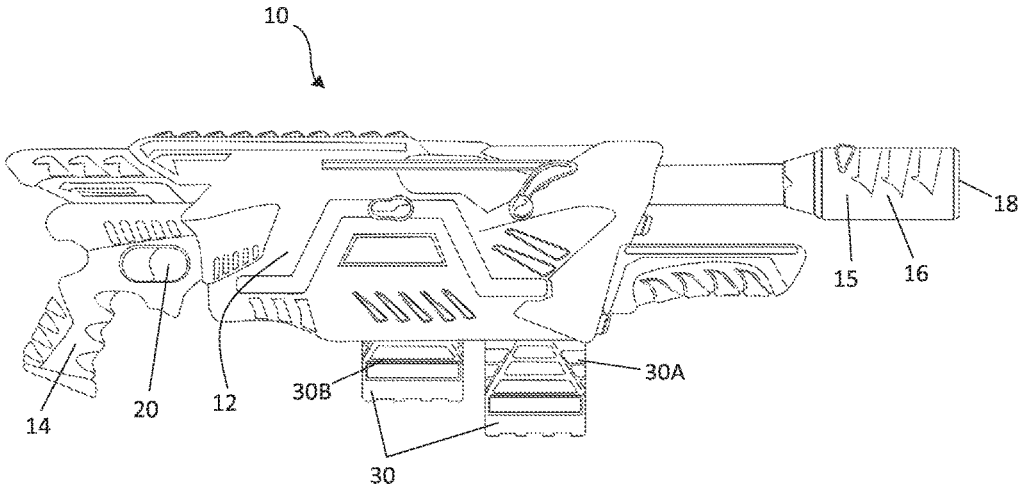
FIG. 1A is a side, external view showing an embodiment of a toy gun according to the present invention, with a barrel of the toy gun being arranged in its extended state.
Figure 1B:
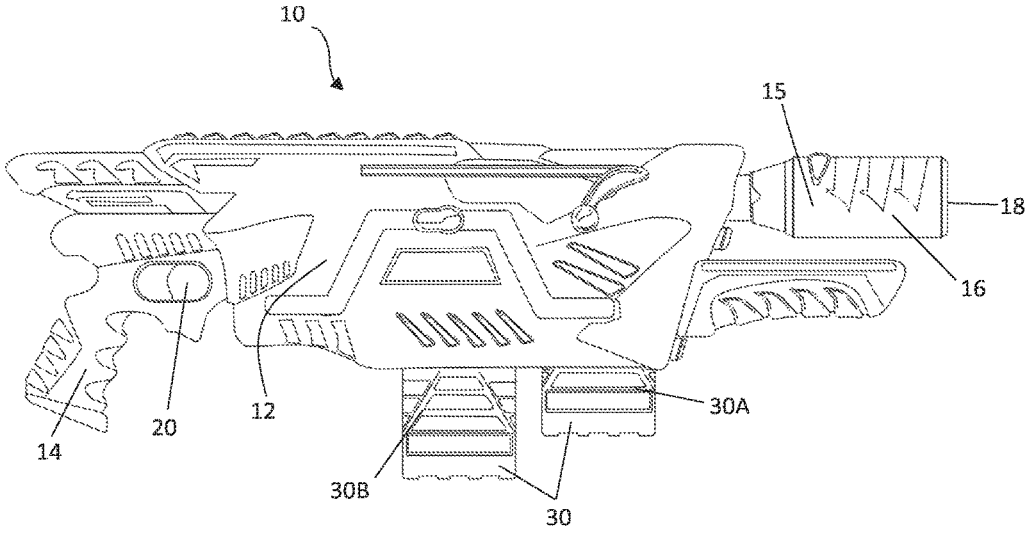
FIG. 1B is a side, external view of the toy gun of FIG. 1B with the barrel arranged in its retracted state.

Referring to FIGS. 1A and 1B, shown is a projectile firing toy in the form of a toy gun 10 according to an embodiment of the present invention. The toy gun 10 is generally configured with a gun body 12 having a hand grip or handle 14, a barrel 16, a muzzle 18 arranged at the end of the barrel 16, a trigger 20 for triggering launching of a projectile, and a projectile launching mechanism 25 for launching the projectile via the barrel 16. The toy gun 10 further comprises a plurality of magazines 30 for accommodating one or more projectiles in the toy gun 10. The projectiles may include any common projectiles for use in toy guns such as, but not limited to, darts or bullets of any forms. The magazines 30 may also be adapted to accommodate projectiles of the same or different types, designs and/or configurations, depending on the preference of the user.

The magazines 30 are preferred to be releasably mountable at the gun body 12, such that any one or more emptied magazines 30 can be detached from the gun body 12 for refilling of the projectiles, or be replaced by one or more new or previously filled magazines. Yet in another embodiment, the plurality of magazines 30 can also be fixedly connected or integrally formed with the gun body 12, with the projectiles being loaded from the side of the gun body by the user.

Particularly, the magazines 30 are each arranged to move in turn to a projectile loading position to thereby align the respective, uppermost projectile carried by the corresponding magazine with the barrel 16 for launching by the projectile launching mechanism 25. For example, the toy gun 10 may comprise two magazines 30A and 30B, each of which is arranged to move reciprocally to the projectile loading position in response to movement of a slide member 15. In the embodiment as shown in FIGS. 1A and 1B, the slide member 15 can be provided in the form of, connected to, or formed integrally with the barrel 16, such that movement of the barrel 16 between a first, extended position and a second, retracted position results in the magazines 30A and 30B moving reciprocally in turn to said projectile loading position. Specifically, when the barrel 16 is arranged at its extended state or position as shown in FIG. 1A, the second magazine 30B is made to move up to the projectile loading position, as indicated by the upward positioning of the magazine 30B, whilst the first magazine 30A is left at its lower, standby position; when the barrel 16 is arranged at its retracted state or position as shown in FIG. 1B, the first magazine 30A is then made to move up to the projectile loading position, whilst the second magazine 30B is left at its lower, standby position. The extended and the retracted states or positions of the barrel 16 can be achieved by, for example, a reciprocal, pumping action by the user and/or by operation of the trigger 20.

In one further embodiment, the magazines 30A and 30B can be used to store different types of projectiles, such as but not limited to, darts or bullets of different sizes or designs such that, depending on the user's shooting or game preference, the barrel 16 is operable to load the specific magazine to the projectile loading position and thus, to select the particular type of projectiles to be launched by the toy gun 10.

Figure 2A:
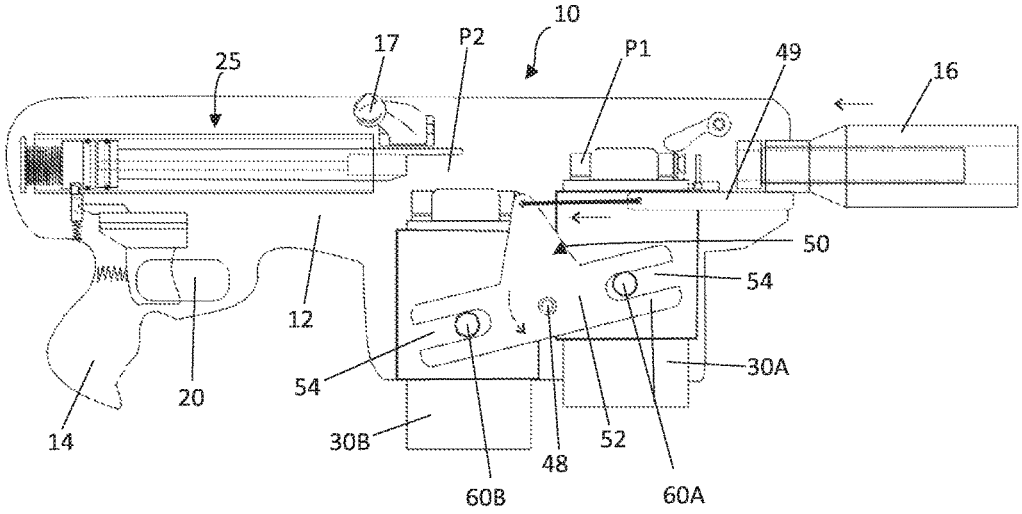
FIGS. 2A to 2G show the operating steps of the toy gun of FIGS. 1A and 1B.
Figure 2B:
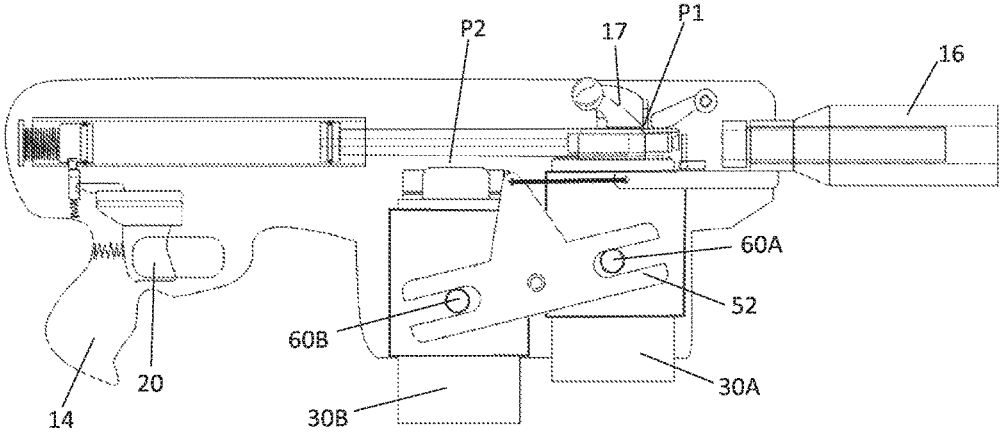
Figure 2C:
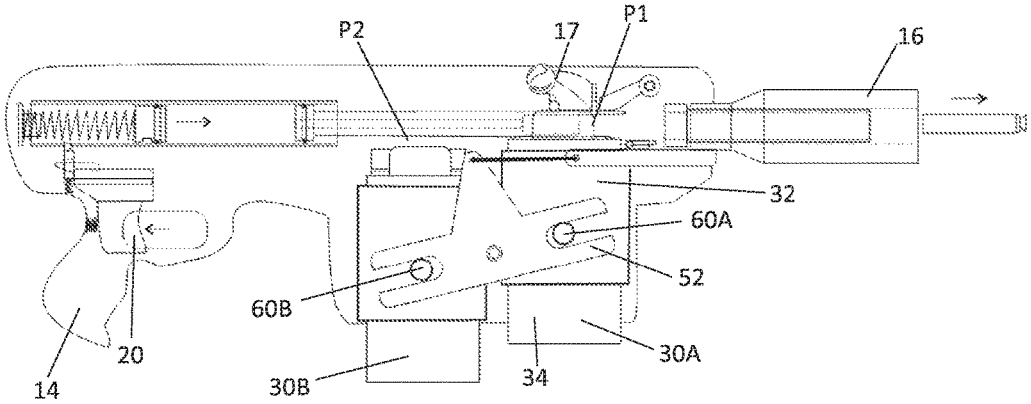
Figure 2D:
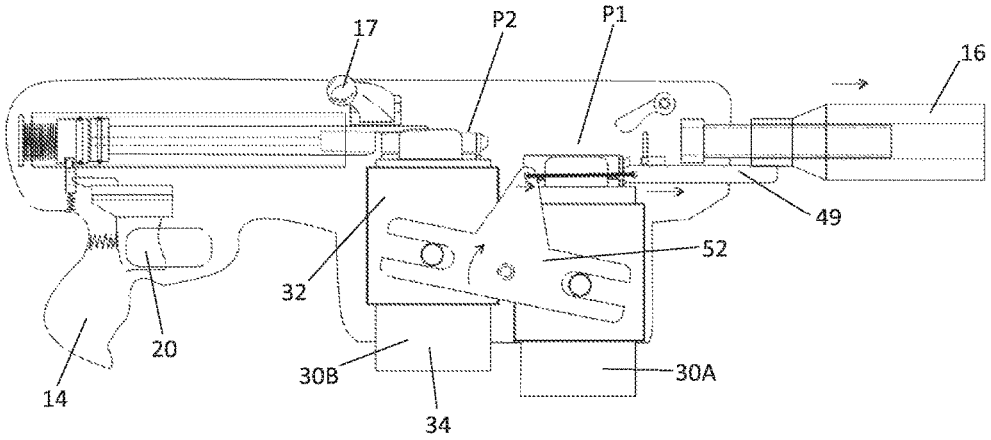
Figure 2E:
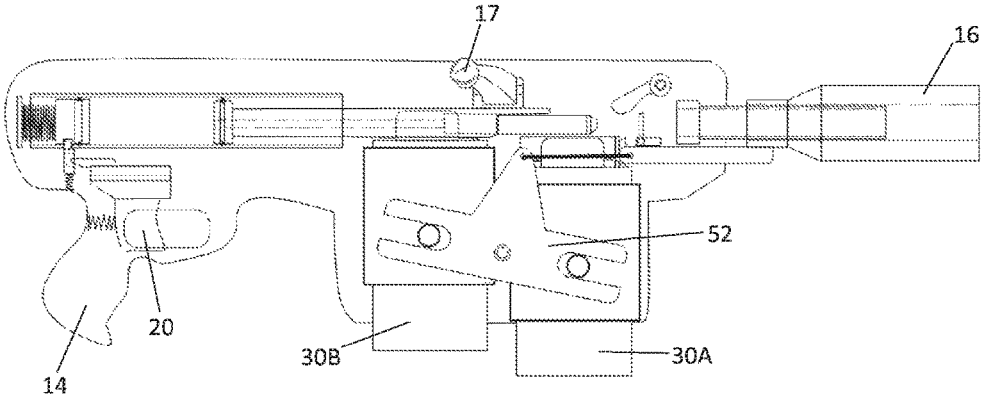
Figure 2F:
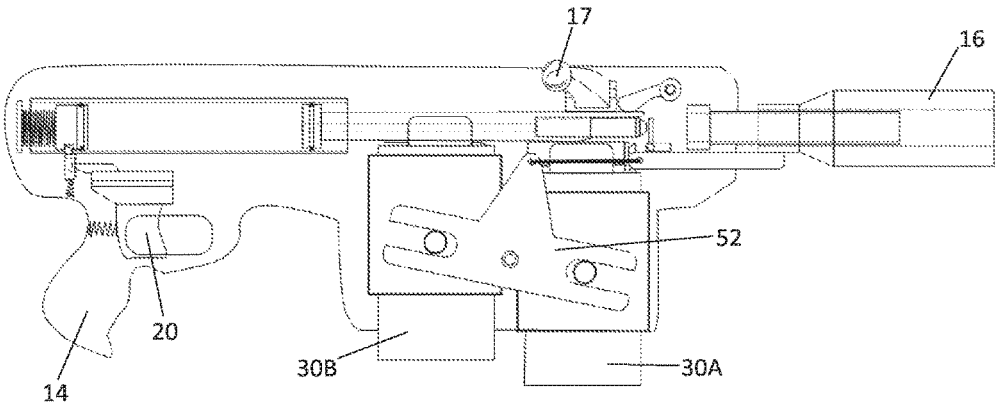
Figure 2G:
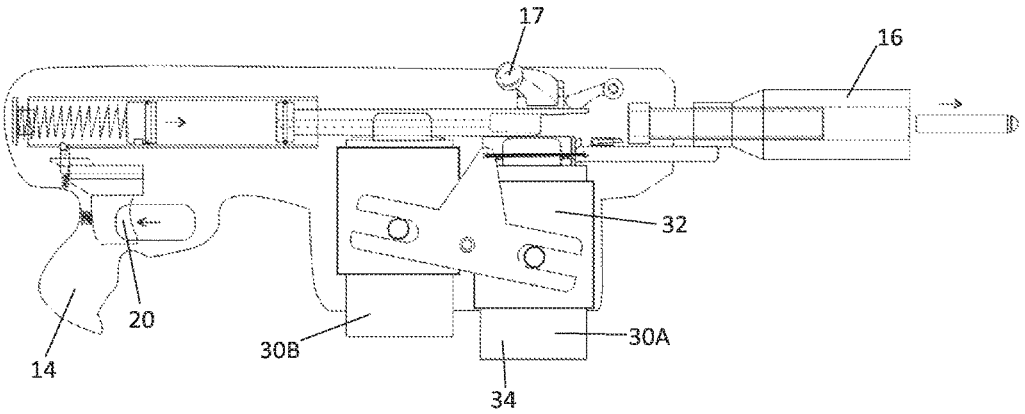

Detailed internal features and operating steps of the embodied toy gun 10 are further illustrated in FIGS. 2A to 2G. Referring to FIGS. 2A to 2C, shown is the toy gun 10 with barrel 16 in its retracted position. In this configuration, the magazine 30A is arranged in the first projectile loading position P1, i.e. for the loaded projectile to align with a projectile passageway of the barrel 16 ready for launching. The magazine 30B is in turn arranged at its lower, standby position and thus, the second projectile loading position P2 is left vacant. The first projectile loading position P1 and the second projectile loading position P2 are preferred to be arranged in-line along the longitudinal axis of the barrel 16 and specifically, each aligned with the projectile passageway of the barrel 16. In this embodiment, the first projectile loading position P1 is adjacent the barrel 16, and the second projectile loading position P2 is spaced from the barrel 16.

As shown in FIG. 2A, the barrel 16 and the magazines 30A and 30B can be movably connected with a connecting means 50 via a number of linkage means 49. In this embodiment, the connecting means 50 may comprise a lever 52 pivotally movable about a pivot joint 48 at the center. The lever 52 can be configured with a plurality of recesses 54, such as but not limited to the two slots 54 as shown in the figure. Each of the two slots 54 is adapted to slidably receive a respective protrusion 60 provided at each of the magazines 30A and 30B. In response to movement of the barrel 16 between the extended and the retracted states and thus movement of the linkage means 49, the protrusions 60A, 60B of the magazines 30A, 30B are caused to slide along the respective slots 54 of the lever 52, thereby moving the magazines 30A, 30B reciprocally in turn to their respective projectile loading position P1 and P2.

FIG. 2B further illustrates the positioning of the projectile at the first projectile loading position P1 by a projectile positioning means 17. Specifically, the positioning means 17 is slidable from a rear end of the gun body 12 to the front end to position the projectile at the right position of P1. FIG. 2C shows the actuating of the trigger 20 which actuates the projectile launching mechanism 25 to fire the positioned projectile from P1 via the barrel 16.

Referring to FIGS. 2D to 2G, shown is the toy gun 10 with barrel 16 being moved to its extended position. Movement of the barrel 16 and thus the linkage means 49 cause the lever 52 to pivot. As a result, the magazine 30B is raised to the second projectile loading position P2. The magazine 30A is thus, in turn, arranged to move to its lower, standby position with the first projectile loading position P1 being left vacant. The positioning member 17 will subsequently be slidably moved to position the loaded projectile from P2 to P1 for launching.

Preferably, each of the magazines 30A, 30B may comprise a magazine housing 32 adapted to releasably receive a respective container 34, with the containers 34 being adapted to accommodate the plurality of projectiles. The containers 34 are preferred to be releasably detachable from the housing 32 for refilling of the projectiles.

Figure 3A:
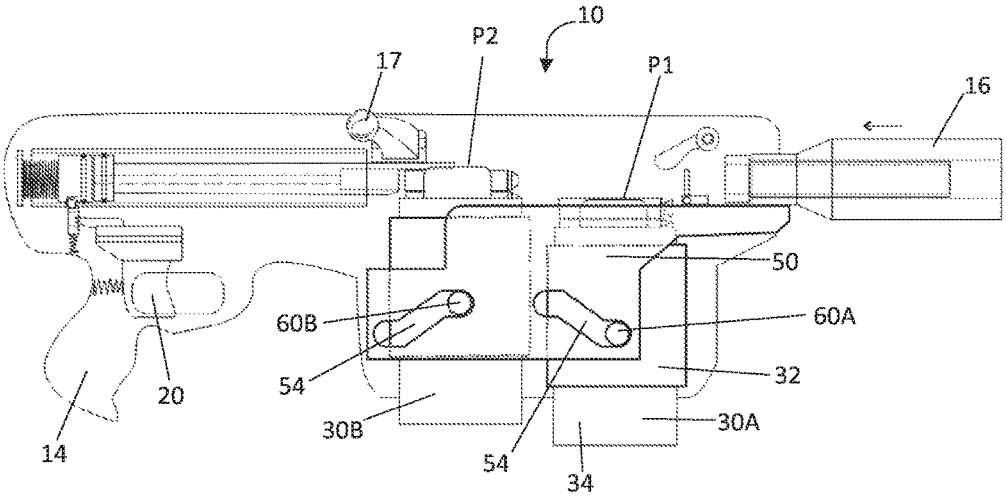
FIG. 3A is a side, internal view showing another embodiment of the toy gun according to the present invention, with a barrel of the toy gun being arranged in a restricted state.
Figure 3B:
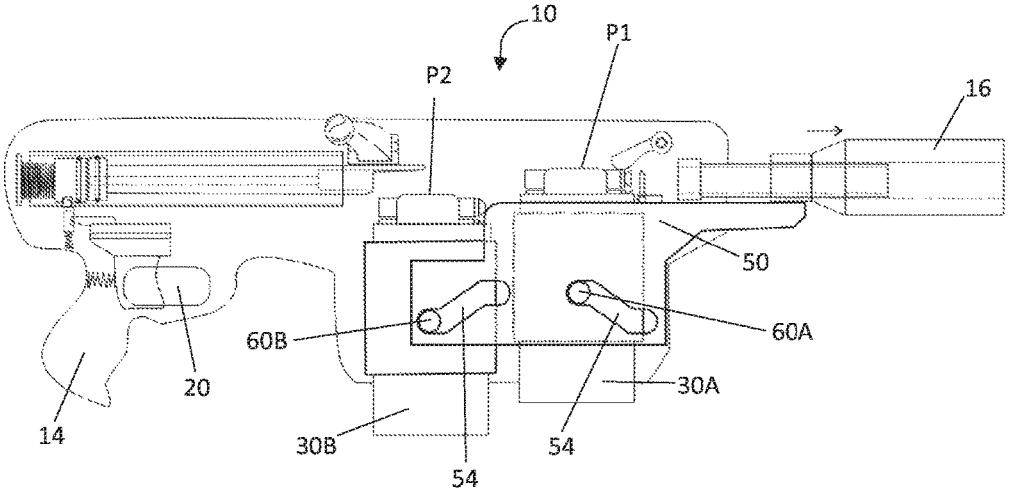
FIG. 3B is a side, internal view showing the toy gun of FIG. 3A with the barrel arranged in its extended state.

FIGS. 3A and 3B show a further embodiment of the toy gun 10 according to the present invention. Similar to the toy gun of the previous embodiment, the toy gun 10 comprises a connecting member 50 adapted to movably connect the barrel 16 with the magazines 30A and 30B. Specifically, the connecting member 50 is configured to comprise a plurality of recesses 54, such as the "Z-shaped" recesses as shown in this example. Each of the recesses 54 is adapted to slidably receive a respective protrusion 60 provided at each of the magazines 30A and 30B. In use, movement of the barrel 16 between the retracted position (i.e. FIG. 3A) and the extended position (i.e. FIG. 3B) will cause the respective protrusions 60A, 60B of the magazines 30A, 30B to slide along the respective recesses 54, thereby moving the magazines 30A, 30B reciprocally in turn to the first projectile loading position P1 and the second projectile loading position P2, respectively.

Figure 4A:
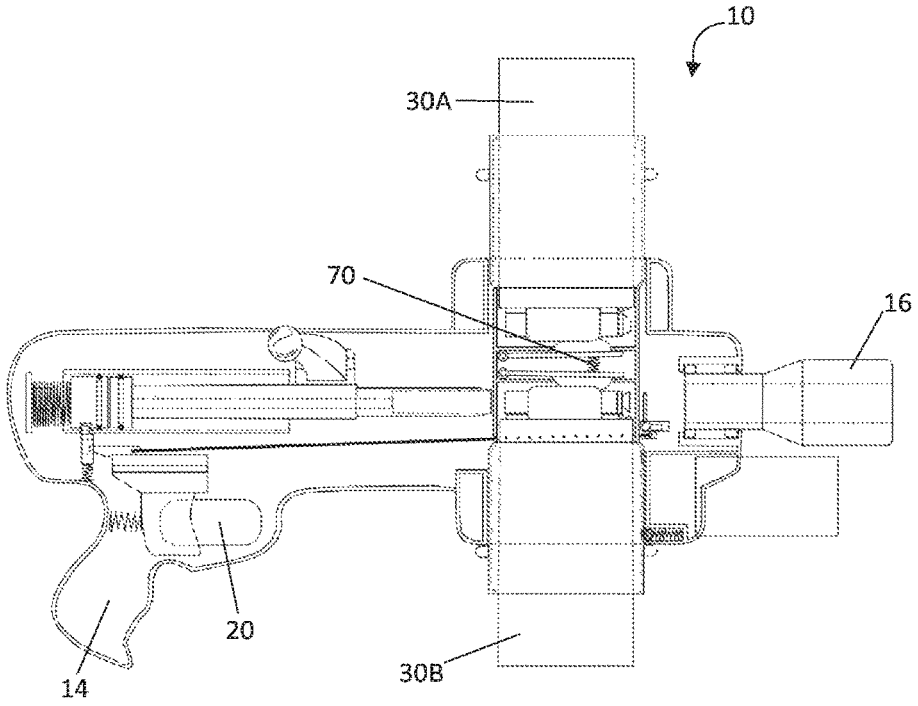
FIG. 4A is a side internal view showing a further embodiment of the toy gun according to the present invention.
Figure 4B:
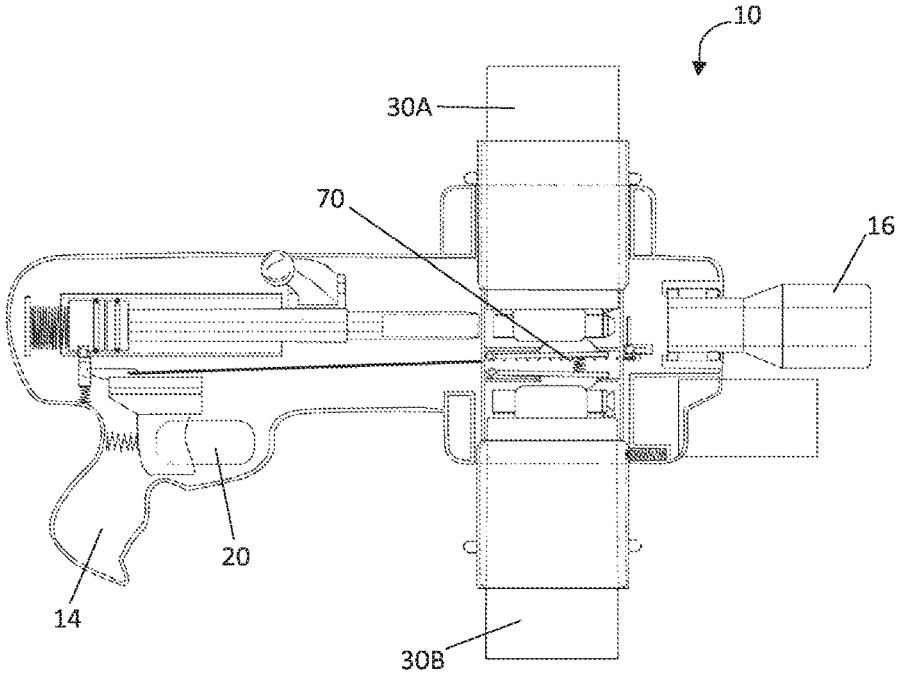
FIG. 4B is another side internal view of the toy gun of FIG. 4B.

Preferably, the plurality of magazines 30 such as the magazines 30A and 30B as described above are arranged in-line and along a side of the gun toy 12. However, the present invention shall not be limited to the specific examples described. Instead, any other variations in arrangements and configurations of the magazines, the barrel and/or other parts of the toy gun without departing from the scope of the present invention, shall also be encompassed. For example, in one embodiment of the toy gun, one of the plurality of magazines can be arranged on an upper side of the gun body 12, while the other one or more of the magazines are arranged on a lower side of the gun body 12. As shown in the embodiment of FIGS. 4A and 4B, for example, the two magazines 30A, 30B are arranged one at each side of the gun body, i.e. one at the upper side and the other at the lower side. Preferably, the two magazines 30A, 30B are aligned with and are arranged opposing to each other. The positioning of the two magazines 30A and 30B allows the user to select the respective, desired sets of stored projectiles to be loaded to the projectile loading position by pushing the corresponding magazine 30A or 30B downward or upward, respectively. Optionally, a spring-loaded means 70 can also be provided to assist with positioning of the loaded projectile in place.

The present description illustrates the principles of the present invention. It will thus be appreciated that those skilled in the art will be able to devise various arrangements that, although not explicitly described or shown herein, embody the principles of the invention and are included within its spirit and scope.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims hereof, any element expressed as a means for performing a specified function is intended to encompass any way of performing that function. The invention as defined by such claims resides in the fact that the functionalities provided by the various recited means are combined and brought together in the manner which the claims call for. It is thus regarded that any means that can provide those functionalities are equivalent to those shown herein.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art is referred to herein, such prior art does not constitute an admission that the prior art forms a part of the common general knowledge in the art.

The invention claimed is:

1. A toy gun, comprising:

a barrel;

a projectile launching mechanism arranged in a body of the gun for launching a projectile from the gun via the barrel;

two magazines each of which being configured to accommodate a plurality of projectiles;

wherein each magazine of the two magazines are movably connected relative to one another and wherein the gun is configured to reciprocally move each magazine to allow reciprocal movement of the magazines to a projectile loading position to thereby align a projectile with the barrel for launching by the projectile launching mechanism.

2. The toy gun according to claim 1, wherein said magazines are movably connected relative to one another to allow reciprocal movement of the magazines to said projectile loading position in response to movement of a slide member arranged at or formed integrally with the barrel.

3. The toy gun according to claim 2, wherein the slide member is arranged at or formed integrally with the barrel such that, in response to a sliding movement of said slide member, said magazines are movable reciprocally to said projectile loading position.

4. The toy gun according to claim 3, wherein said barrel is slidably movable between a first position and a second position relative to the body of the toy gun such that, in response to the sliding movement of the barrel between the first and the second positions, said magazines are movable reciprocally to said projectile loading position.

5. The toy gun according to claim 4, wherein the magazines comprises two magazines movably connected to allow reciprocal movement of the magazines to said projectile loading position.

6. The toy gun according to claim 5, wherein the projectile loading position comprises a first projectile loading position and a second projectile loading position such that, when the barrel is slidably moved to its first position, a first magazine moves to the first projectile loading position; and when the barrel is slidably moved to its second position, a second magazine moves to the second projectile loading position.

7. The toy gun according to claim 4, wherein the barrel is configured to move reciprocally between its first and the second positions.

8. The toy gun according to claim 1, wherein the magazines are arranged along a side of the body.

9. The toy gun according to claim 6, wherein the first projectile loading position and the second projectile loading position are arranged in-line along a longitudinal axis of the barrel.

10. The toy gun according to claim 6, wherein the first projectile loading position and the second projectile loading position are arranged to align with a projectile passageway of the barrel.

11. The toy gun according to claim 4, further comprising a connecting means configured to movably connect the barrel with the plurality of magazines.

12. The toy gun according to claim 11, wherein the connecting means comprises a lever.

13. The toy gun according to claim 11, wherein the connecting means comprises a plurality of recesses each of which being configured to slidably receive a respective protrusion provided at each of the magazines.

14. The toy gun according to claim 13, wherein, in response to movement of the barrel between the first and the second positions, the respective protrusions of the magazines are configured to slidably move along the respective recesses of the connecting means.

15. The toy gun according to claim 1, wherein the magazines each comprises a magazine housing configured to releasably receive a respective container, with the respective container being constructed to accommodate the plurality of projectiles.

16. The toy gun according to claim 6, wherein the first projectile loading position is adjacent the barrel, and the second projectile loading position is spaced from the barrel.

17. The toy gun according to claim 16, further comprising a projectile positioning means configured to position a projectile from the second projectile loading position to the first projectile loading position.

18. The toy gun according to claim 1, wherein the magazines are releasably mounted at the body of the toy gun.

19. The toy gun according to claim 1, wherein the magazines are arranged one at each side of the gun body.

20. The toy gun according to claim 19, wherein the two magazines are aligned with and are arranged opposing to each other.

* * * * *